US009008548B2

(12) United States Patent
Murodate et al.

(10) Patent No.: US 9,008,548 B2
(45) Date of Patent: Apr. 14, 2015

(54) FIXING DEVICE PROVIDED WITH REINFORCED NIP MEMBER

(71) Applicant: Brother Kogyo Kabushiki Kaisha, Nagoya-shi, Aichi-ken (JP)

(72) Inventors: Yusuke Murodate, Nagoya (JP); Akihiro Kobayashi, Inazawa (JP); Tomoaki Hazeyama, Yokkaichi (JP); Naoyuki Iwata, Kakamigahara (JP); Yasuhiro Maruyama, Kasugai (JP); Yuji Nishigaki, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/227,011

(22) Filed: Mar. 27, 2014

(65) Prior Publication Data

US 2014/0294462 A1 Oct. 2, 2014

(30) Foreign Application Priority Data

Mar. 29, 2013 (JP) ..... 2013-074362

(51) Int. Cl.
*G03G 15/16* (2006.01)
*G03G 15/20* (2006.01)

(52) U.S. Cl.
CPC ..... *G03G 15/2017* (2013.01); *G03G 15/2053* (2013.01); *G03G 2215/2064* (2013.01); *G03G 2215/2035* (2013.01)

(58) Field of Classification Search
CPC ..... G03G 15/2017; G03G 2215/2035; G03G 2215/2064
USPC ..... 399/122, 329
See application file for complete search history.

(56) References Cited

U.S. PATENT DOCUMENTS

| | | | | |
|---|---|---|---|---|
| 6,775,509 | B2 | 8/2004 | Shida et al. | |
| 2003/0156866 | A1 | 8/2003 | Shida et al. | |
| 2003/0170054 | A1* | 9/2003 | Suzuki et al. | 399/328 |
| 2011/0170920 | A1 | 7/2011 | Fujiwara et al. | |

(Continued)

FOREIGN PATENT DOCUMENTS

| | | | | |
|---|---|---|---|---|
| JP | 08006409 A * | 1/1996 | | G03G 15/20 |
| JP | 2003-228246 A | 8/2003 | | |

(Continued)

OTHER PUBLICATIONS

Co-Pending U.S. Appl. No. 14/227,016, filed Mar. 27, 2014.
Co-pending U.S. Appl. No. 14/227,025, filed Mar. 27, 2014.
Co-Pending U.S. Appl. No. 14/227,040, filed Mar. 27, 2014.

*Primary Examiner* — Benjamin Schmitt
(74) *Attorney, Agent, or Firm* — Banner & Witcoff, Ltd.

(57) ABSTRACT

A fixing device includes a metal plate, an endless belt, a rotating body, and a stay. The metal plate has a main part comprising a first end portion, a second end portion, and a center portion positioned therebetween and having rigidity higher than that of the first end portion and the second end portion. The endless belt has an inner peripheral surface configured to be in sliding contact with the metal plate. The main part is aligned with the rotating body in a direction from the metal plate to the rotating body. The stay is disposed opposite to the nip region with respect to the metal plate. The stay and the main part of the metal plate are deformable upon application of the load to the stay such that the main part provides a convex shape protruding toward the rotating body.

14 Claims, 5 Drawing Sheets

(56) References Cited

U.S. PATENT DOCUMENTS

2013/0084111 A1* 4/2013 Iwata ..... 399/329
2013/0195527 A1* 8/2013 Suzuki et al. ..... 399/329

FOREIGN PATENT DOCUMENTS

JP 3817482 B2 9/2006
JP 2011-137933 A 7/2011

* cited by examiner

FIXING DEVICE PROVIDED WITH REINFORCED NIP MEMBER

CROSS REFERENCE TO RELATED APPLICATION

This application claims priority from Japanese Patent Application No. 2013-074362 filed Mar. 29, 2013. The entire content of the priority application is incorporated herein by reference.

TECHNICAL FIELD

The present invention relates to a fixing device that thermally fixes a transferred developing agent image to a sheet.

BACKGROUND

Japanese Patent No. 3817482 discloses a fixing device that includes an endless belt, a nip member disposed at an internal space of the endless belt, and a pressure roller that opposes the nip member so as to interpose the endless belt between the pressure roller and the nip member. Specifically, a surface of the nip member that is in contact with the endless belt is subjected to machining to have a convex surface in contact with the endless belt and having a central portion and end portions in an axial direction of the endless belt. The central portion has a protruding amount protruding toward the pressure roller greater than that of the end portions. In this way, wrinkling of recording sheets can be prevented.

SUMMARY

However, with conventional technology, a protrusion amount of a central portion of the nip member must be adjusted directly by subjecting to machining a surface of the nip member to be in contact with the endless belt. A problem which arises as a result is that achieving dimensional accuracy is difficult, and errors in the protrusion amount increase.

In view of the foregoing, it is an object of the present invention to provide a fixing device capable of decreasing errors in the protrusion amount of the central portion of the nip member (nip plate).

In order to attain the above and other objects, the present invention provides a fixing device that may include a metal plate, an endless belt, a rotating body, and a stay. The metal plate may have a main part comprising a first end portion, a second end portion, and a center portion positioned therebetween and having rigidity higher than that of the first end portion and the second end portion. The endless belt may have an outer peripheral surface and an inner peripheral surface configured to be in sliding contact with the metal plate in a sliding direction. The rotating body may be configured to rotate and defines an axial direction. The metal plate and the rotating body may be configured to nip the endless belt therebetween. The endless belt and the rotating body may be configured to form a nip region therebetween. The main part may be aligned with the rotating body in a direction from the metal plate to the rotating body. The second end portion may be opposite to the first end portion with respect to the center portion in the axial direction. The stay may be disposed opposite to the nip region with respect to the metal plate, and may be configured to receive a load from the rotating body through the metal plate. The stay and the main part of the metal plate may be configured to deform such that the main part provides a convex shape protruding toward the rotating body when the stay receives a load from the rotating body through the metal plate.

DETAILED DESCRIPTION

Figure 1:
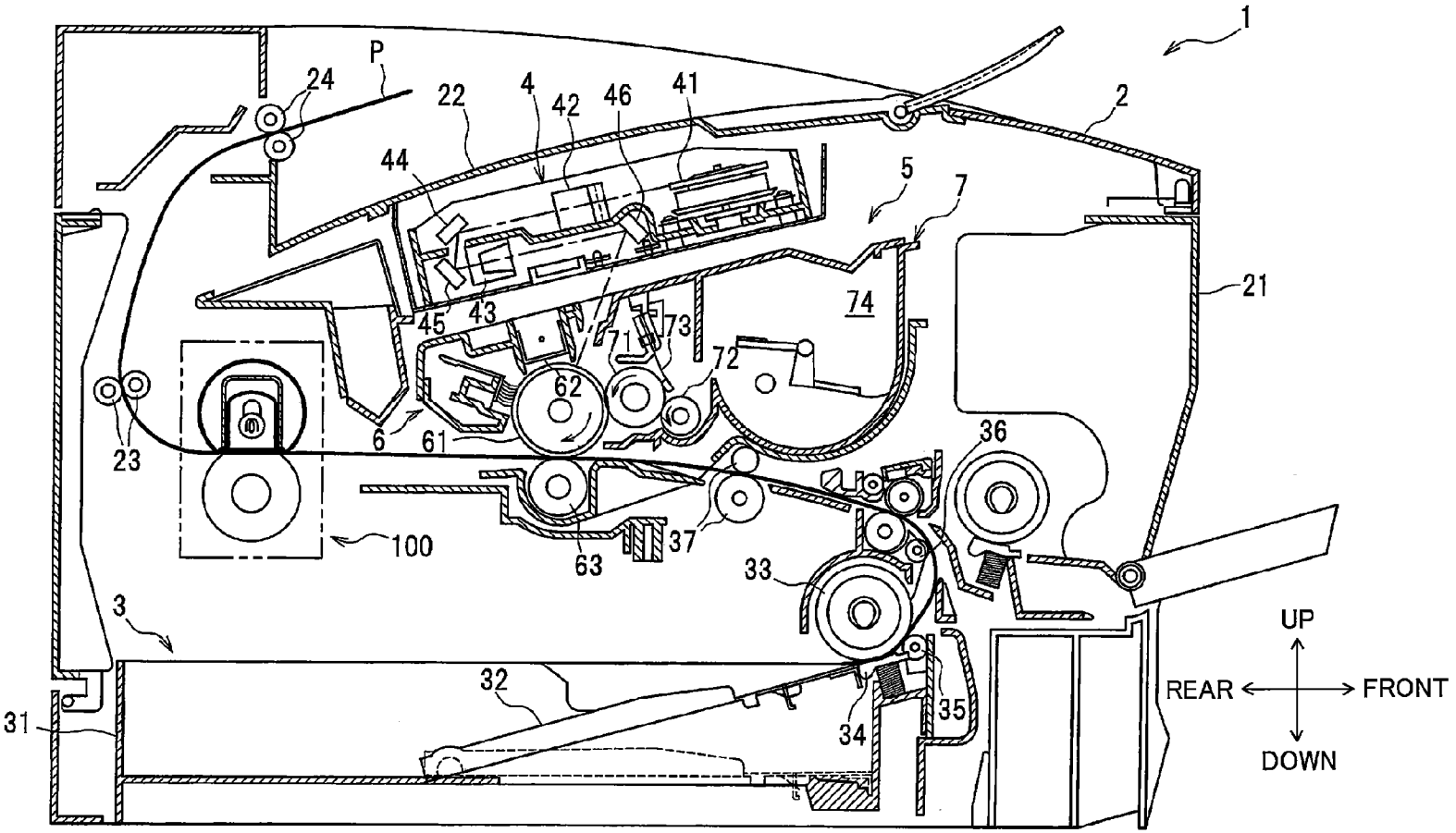
FIG. 1 is a schematic cross sectional view showing a structure of a laser printer having a fixing device according to one embodiment of the present invention.

A general structure of a laser printer as an image forming device according to one embodiment of the present invention will be described with reference to FIG. 1. A laser printer 1 shown in FIG. 1 is provided with a fixing device 100 according to the embodiment of the present invention. A detailed structure of the fixing device 100 will be described later while referring to FIGS. 2 to 4B.

General Structure of Laser Printer

As shown in FIG. 1, the laser printer 1 includes a main frame 2. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" will be used assuming that the laser printer 1 is disposed in an orientation in which it is intended to be used. More specifically, in FIG. 1, a left side and a right side of the figure are a rear side and a front side of the printer, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35 and 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35 and 36, and the registration rollers 37.

The exposure unit 4 is disposed at an upper portion of the main frame 2. The exposure unit 4 includes a laser emission unit (not shown), a polygon mirror 41, lenses 42 and 43, and reflection mirrors 44, 45 and 46. In the exposure unit 4, the laser emission unit is adapted to project a laser beam based on image data so that the laser beam is deflected by or passes through the polygon mirror 41, the lens 42, the reflection mirrors 44 and 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a doctor blade 73 for regulating toner thickness, and a toner accommodating portion 74 in which toner is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the doctor blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

Detailed Structure of Fixing Device

Figure 2:
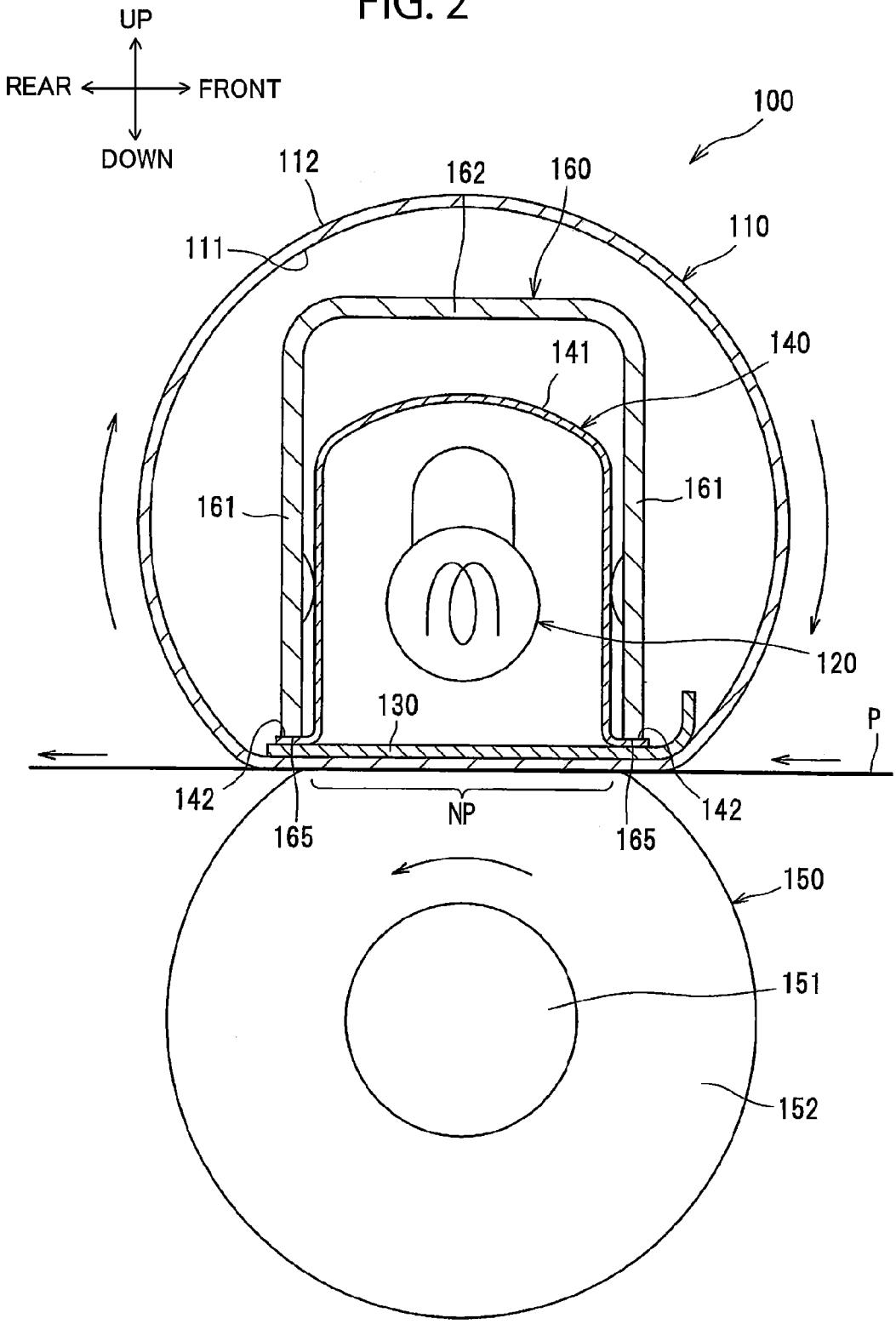
FIG. 2 is a cross sectional view of the fixing device.
Figure 3:
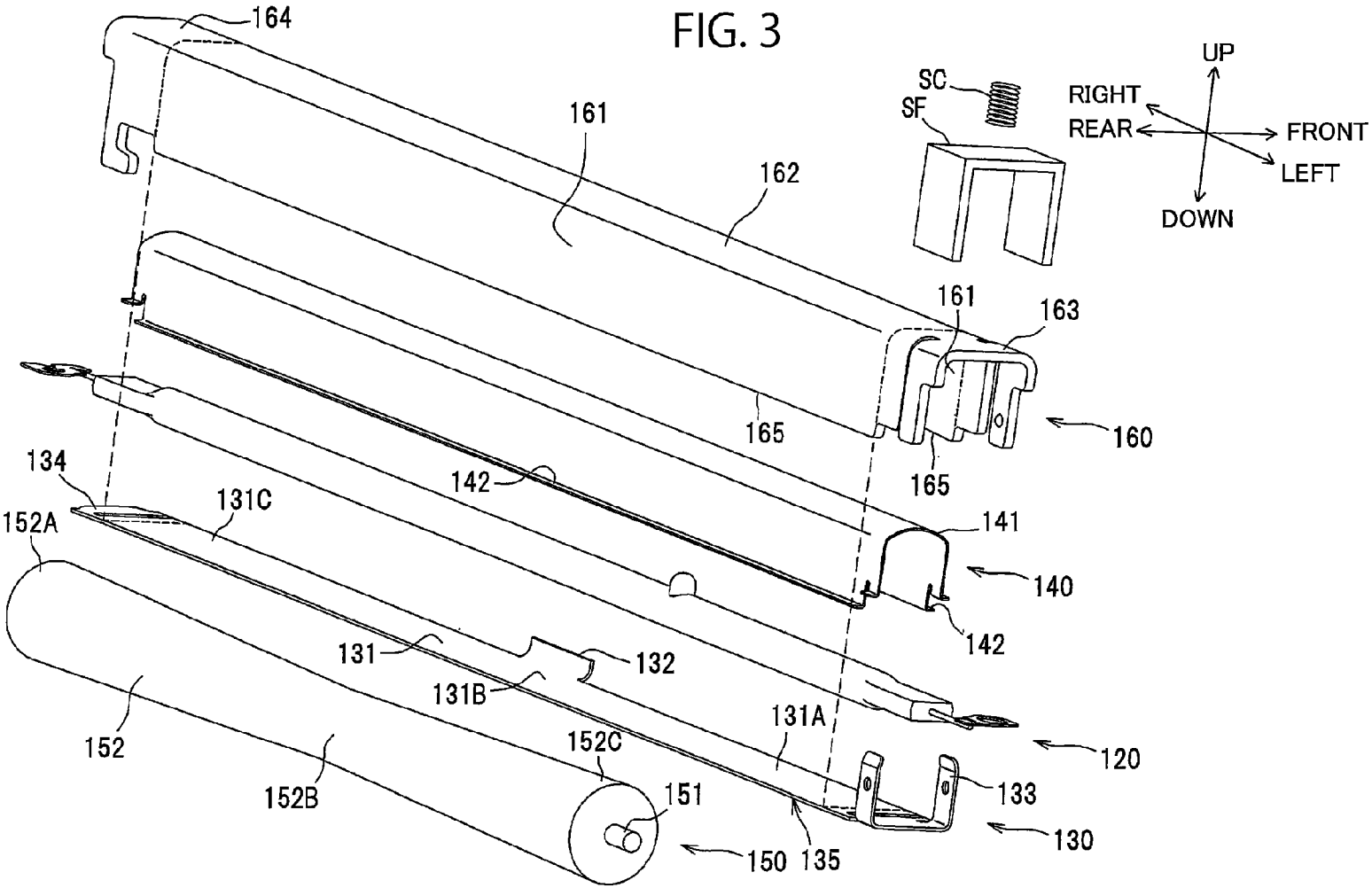
FIG. 3 is an exploded perspective view showing a halogen lamp, a nip plate, a reflection plate, a pressure roller, and a stay.

As shown in FIGS. 2 and 3, the fixing device 100 includes a fusing belt 110, a halogen lamp 120, a nip plate 130, a reflection plate 140, a pressure roller 150, and a stay 160. In FIG. 3, for the sake of convenience a length of the pressure roller 150 in the leftward/rightward direction is shown as being shorter than that of the nip plate 130, but in actuality the length of the pressure roller 150 in the leftward/rightward direction is approximately the same as that of a main part 135 of the nip plate 130. (See FIG. 4A.)

The fusing belt 110 is a heat-resistant and flexible endless belt. The fusing belt 110 has a metallic tube made from stainless steel, and a fluorocarbon resin layer coated thereover. The fusing belt 110 has an inner peripheral surface 111 in sliding contact with the nip plate 130, and an outer peripheral surface 112 in sliding contact with the pressure roller 150.

The inner peripheral surface 111 is in sliding contact with the nip plate 130 and runs rearward relative to the nip plate 130. Here, the sliding direction of the inner peripheral surface 111 relative to the nip plate 130 refers to an average direction in which the inner peripheral surface 111 is in sliding contact with any points of the nip plate 130 in the frontward/rearward direction. In the depicted embodiment, the sliding contact direction refers to a direction extending in the frontward/rearward direction in FIG. 2. In other words, the sliding contact direction refers to a direction that extends from an upstream end to a downstream end of a nip region NP relative to a rotation direction of the pressure roller 150.

As a modification to the fusing belt 110, a rubber layer can be provided between the metallic tube and the fluorocarbon resin layer.

The halogen lamp 120 is a heating element that emits radiant heat which heats the nip plate 130 and the fusing belt 110, and thereby heats the toner on the sheet P. The halogen lamp 120 is disposed at an interior side of the fusing belt 110, and spaced away a prescribed distance from interior surfaces of the fusing belt 110 and the nip plate 130. The halogen lamp 120 heats the fusing belt 110 indirectly through the nip plate 130.

The nip plate 130 is an elongated metallic plate extending in the leftward/rightward direction having a substantially planar shape. The nip plate 130 is in sliding contact with the inner peripheral surface 111 of the tubular fusing belt 110.

The nip plate 130 can be coated with a film made from a nonmetallic oxide film or a fluororesin coating. In addition, the nip plate 130 is adapted to transfer the radiant heat received from the halogen lamp 120 and onto the toner on the sheet P through the fusing belt 110.

This nip plate 130 is formed into a planar shape and is made from a metal, for example, aluminum, so as to have a thermal conductivity higher than that of a stay 160 made from steel (described later). This nip plate 130 has a thickness permitting bending deformation thereof. The thickness of the nip plate 130 can be ranging from 0.1 to 3.0 mm, or 0.3 to 2.0 mm, or 0.1 to 1.0 mm.

The reflection plate 140 is adapted to reflect radiant heat from the halogen lamp 120 toward the nip plate 130. The reflection plate 140 is positioned within the fusing belt 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing belt 110.

The reflection plate 140 is configured into substantially U-shape in cross-section and is made from a material such as aluminum having high reflection ratio for infrared rays or far infrared rays. The reflection plate 140 has a substantially U-shaped reflection portion 141 and a flange portion 142 extending outward from each end portion of the reflection portion 141 in the frontward/rearward direction. A mirror surface finishing is applicable on the surface of the aluminum reflection plate 140 for specular reflection in order to enhance heat reflection ratio.

The pressure roller 150 is an elastically deformable member. The pressure roller 150 is disposed downward of the nip plate 130 to vertically oppose the outer peripheral surface 112 of the fusing belt 110. The pressure roller 150 is rotatable about its central axis. The pressure roller 150 is configured to provide the nip region NP in cooperation with the fusing belt 110, when the fusing belt 110 is nipped between the pressure roller 150 and the nip plate 130 while the pressure roller 150 is in an elastically deformed state.

The pressure roller 150 has a metallic shaft 151 and a rubber layer 152 coated thereover. The shaft 151 is formed into a linear shape, with a radius that is substantially constant across the leftward/rightward direction.

The rubber layer 152 has a first end portion 152A, a central portion 152B, and a second end portion 152C, in the axial direction (leftward/rightward direction) of the pressure roller 150. The rubber layer 152 is formed into a concave shape such that respective diameters of the end portions 152A and 152C are larger than that of the central portion 152B regardless of whether or not fixing operation is performed, i.e. regardless of heat application. In other words, the rubber layer 152 is formed such that the end portions 152A and 152C are thicker than the central portion 152B.

The pressure roller 150 is rotationally driven upon transmission of a drive force from a drive motor (not shown) disposed in the main frame 2. By the rotation of the pressure roller 150, the fusing belt 110 is circularly driven because of a friction force generated therebetween or between the sheet P and the fusing belt 110. A toner image (toner) transferred onto the sheet P can be thermally fixed thereto by heat and pressure during passage of the sheet P at the nip region NP between the pressure roller 150 and the heated fusing belt 110.

The stay 160 is adapted to support the end portions of the nip plate 130 through the flange portions 142 for maintaining rigidity of the nip plate 130. The stay 160 is positioned on the opposite side of the nip region NP with respect to the nip plate 130. The stay 160 has a substantially U-shape configuration in conformity with the outer shape of the reflection portion 141 to cover the reflection plate 140. For fabricating the stay 160, a highly rigid member such as a steel plate is folded into substantially U-shape.

The stay 160 has a pair of first frames 161, a second frame 162, a left frame 163, and a right frame 164. The first frames 161 are disposed in opposition to each other in the frontward/rearward direction. The second frame 162 is integrally connected to respective upper ends of the first frames 161. The left frame 163 is integrally provided at respective left end sides of the first frames 161 and second frame 162 (a portion leftward of a broken line on a left side of FIG. 3). The right frame 164 is integrally provided at respective right end sides of the first frames 161 and second frame 162 (a portion rightward of a broken line on a right side of FIG. 3).

The left frame 163 and right frame 164 are respectively supported by left and right side frames SF (only the left side of which is shown). The side frames SF are vertically movably supported to a fixing frame (not shown) in the fixing device 100. Further, the nip plate 130 and the reflection plate 140 are indirectly supported by the side frames SF through the stay 160.

In addition, the side frames SF are urged downward by respective coil springs CS (only the left of which is shown), and the side frames SF thereby press the nip plate 130, indirectly through the stay 160 and reflection plate 140, toward the pressure roller 150. Incidentally, as modifications, the halogen lamp 120 can be supported by the above-described side frames SF or by the above-described fixing frame. Moreover, configurations are conceivable wherein the stay 160 and the nip plate 130 are fixed to the fixing frame, and the pressure roller 150 is urged toward the nip plate 130 by an urging member. Moreover, the urging member may be configured with an arm and a coil spring rather than with the coil spring CS.

The second frame 162 constitutes a part of an upper wall of the stay 160 that corresponds to the first frames 161, i.e. a part of the upper wall of the stay 160 that is between the broken lines in FIG. 3 in the leftward/rightward direction. The second frame 162 is plate-shaped, extending in the leftward/rightward direction and in the frontward/rearward direction, and having thickness in the upward/downward direction. The second frame 162 has a substantially uniform rigidity distribution in the leftward/rightward direction. Specifically, the second frame 162 is formed with a sufficiently high rigidity that, when the above-described urging member urges the stay 160 toward the pressure roller 150, the second frame 162 does not undergo substantial deformation.

The first frames 161 are plate-shaped, extending in the upward/downward direction and in the leftward/rightward direction, and having thickness in the frontward/rearward direction. The first frames 161 are formed so as to extend downward from front and rear ends of the second frame 162.

The first frames 161 have respective lower end faces which constitute supporting faces 165. The supporting faces 165 support the nip plate 130 through the flange portions 142 of the reflection plate 140. The supporting faces 165 are configured to receive, through the reflection plate 140 and the nip plate 130, a load (reactive force) from the pressure roller 150.

More specifically, the first frames 161 constitute respective parts of front and rear walls of the stay 160 that have the supporting faces 165 which receive the reactive force from the nip plate 130, i.e. portions of the respective front and rear walls of the stay 160 that are between the broken lines in FIG. 3 in the leftward/rightward direction. Incidentally, since the respective first frames 161 are formed symmetrically in the frontward/rearward direction, a description of only one of the first frames 161 is provided, while a description of the other is omitted in the descriptions below.

Figure 4A:
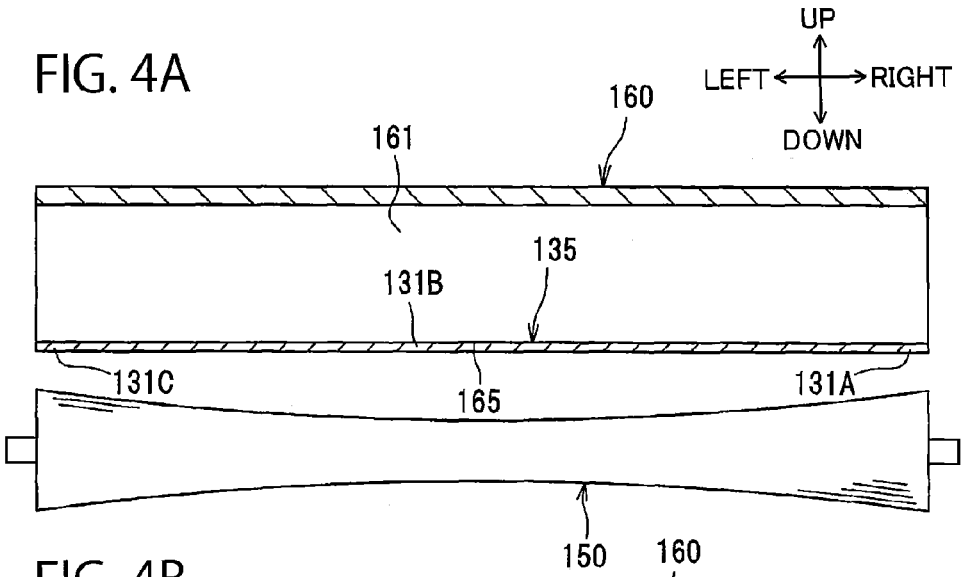
FIGS. 4A and 4B show a relationship between the stay, the nip plate and the pressure roller.

In addition, as shown in FIG. 4A, the supporting faces 165 run in parallel with the leftward/rightward direction when not receiving a load from the pressure roller 150, for instance when there is a paper jam and the nip plate 130 has been separated from the pressure roller 150. Moreover, in the same manner, the nip plate 130 (specifically, a base portion 131) supported by these supporting faces 165 also runs in parallel with the leftward/rightward direction when not receiving a load from the pressure roller 150. Incidentally, in FIGS. 4(*a*) and 4(*b*), members such as the reflection plate 140 and the fusing belt 110 have been omitted for the sake of convenience.

Here, "when not receiving a load from the pressure roller 150" includes times when the fixing device 100 has been disassembled and a load is not being applied to the supporting faces 165 and the nip plate 130. In other words, it is acceptable for the fixing device 100 to be configured such that, as a fully assembled device, no mechanism is provided for releasing nip pressure, and the supporting faces 165 and the nip plate 130 receive a load from the pressure roller 150 uninterruptedly.

Next, the nip plate 130 will be described in detail. As shown in FIG. 3, the nip plate 130 has a main part 135, a left side engaging portion 133 integrally provided on a left end side of the main part 135 (a portion leftward of the broken line on the left side in the figure), and a right side engaging portion 134 integrally provided on a right end side of the main part 135 (a portion rightward of the broken line on the right side in the figure).

The left side engaging portion 133 and right side engaging portion 134 engage with respective end portions of the stay 160 and are thereby held in place by the stay 160.

The main part 135 has a base portion 131 and a reinforcing portion 132. The base portion 131 vertically opposes the pressure roller 150. The reinforcing portion 132 is provided in the center of the base portion 131 in the leftward/rightward direction (the axial direction of the pressure roller 150).

The base portion 131 is a plate-shaped part formed into an elongated shape which extends in the leftward/rightward direction and is perpendicular to the upward/downward direction. Specifically, the base portion 131 is a plate-shaped part which extends from one end to another end of the supporting faces 165 in the leftward/rightward direction. In the leftward/rightward direction, the base portion 131 has a first end portion 131A, a central portion 131B, and a second end portion 131C. In addition, at the central portion 131B of the base portion 131, the reinforcing portion 132 is integrally formed. As a result, the central portion 131B has a higher rigidity than do the first end portion 131A and second end portion 131C.

Figure 4B:
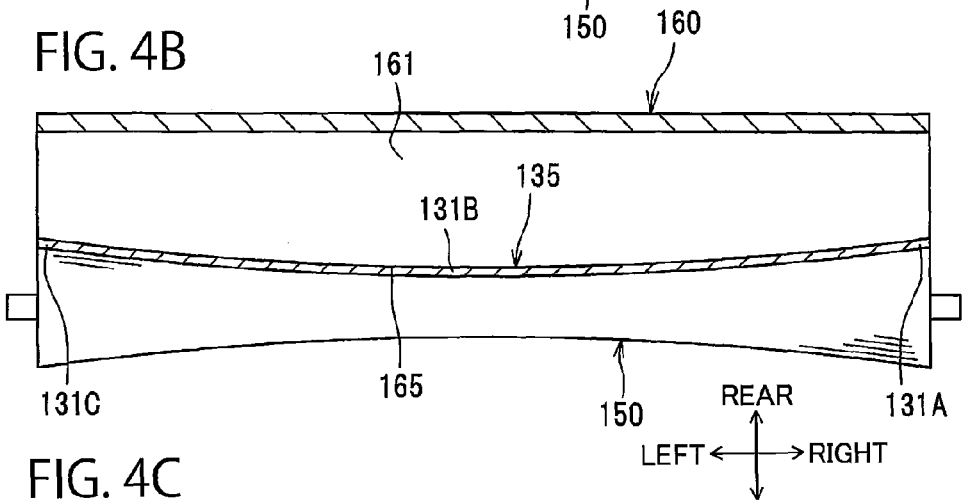

As a result of the central portion 131B of the base portion 131 having a rigidity which is higher than that of the first end portion 131A and second end portion 131C of the base portion 131, when the stay 160 receives a load from the pressure roller 150, for instance during printing, the end portions of the stay 160 and the nip plate 130 in the leftward/rightward direction of the main part 135 undergo more deformation than does the central portion 131B. The main part 135 thereby becomes arc-shaped, protruding toward the pressure roller 150, as shown in FIG. 4B. More specifically, the end portions 131A and 131C of the main part 135 have a rigidity which is lower than that of the central portion 131B of the main part 135, and thus bend more than the central portion 131B in the vertical direction when the main part 135 receives a load from the pressure roller 150. In addition, following the deformation of the end portions 131A and 131C of the main part 135, the end portions of the stay 160 become deformed in the upward/downward direction, or become deformed outplane in the frontward/rearward direction (in other words, become deformed such that the respective lower ends of the pair of first frames 161 open outward). In this way, the main part 135 can be imparted with an arcuate shape wherein the central portion 131B protrudes further toward the pressure roller 150 than do the end portions 131A and 131C.

Thus, by adjusting the rigidity distribution of the main part 135 in the leftward/rightward direction, the protrusion amount of the central portion 131B of the main part 135 can be adjusted as well. Accordingly, errors in the protrusion amount can be reduced in comparison with configurations wherein the protrusion amount of a central portion of a nip member is adjusted directly by machining a surface of a nip member to be in contact with an endless belt, as is conventionally done.

Figure 4C:
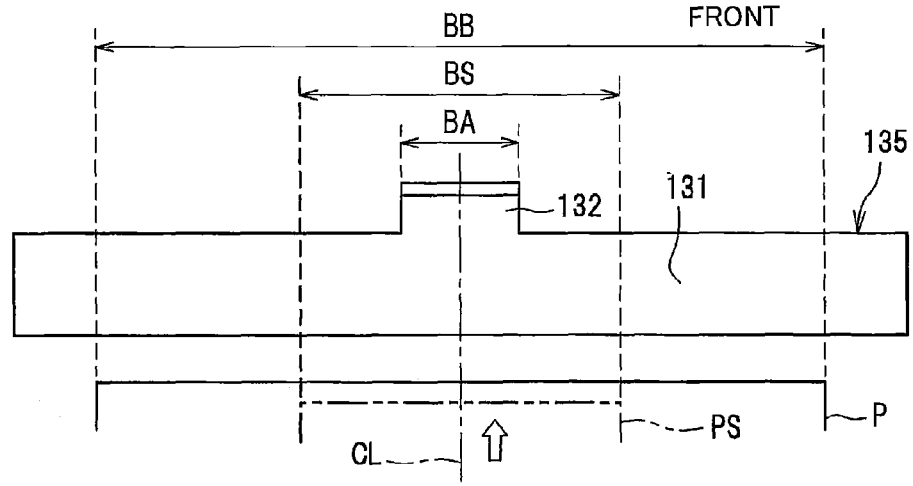
FIG. 4C is a schematic view showing a relationship between a base portion of the nip plate and a sheet.

As shown in FIG. 3, the reinforcing portion 132 is formed so as to bend toward the stay 160 from a front end portion of the central portion 131B of the base portion 131. As shown in FIG. 4C, the reinforcing portion 132 in its entirety is smaller than a sheet width BB in the leftward/rightward direction and moreover is disposed within the sheet width BB in the leftward/rightward direction. Here, sheet width BB refers to any of multiple widths of sheets P which can be specified by the laser printer 1. In other words, the fixing device 100 is configured to convey the sheet P within a conveyance region having a prescribed width (which is the same as the sheet width BB shown) in the leftward/rightward direction, and into the nip region NP. Here, the conveyance region is a region where the sheet P conveyed overlaps with the nip region NP when viewed in the upward/downward direction.

For example, the sheet width BB for determining the size and the position of the reinforcing portion 132 can be 176 mm to conform to B5 size, 215.9 mm to conform to letter and legal size, or 210 mm to conform to A4 size, of the International Organization for Standardization (ISO).

By thusly making the reinforcing portion 132 smaller than the sheet width BB in the leftward/rightward direction and also disposing the reinforcing portion 132 within the sheet width BB in the leftward/rightward direction, the nip plate 130 can be imparted with the above-described arcuate shape within the relevant sheet width BB, and thus the formation of wrinkles on the sheet P corresponding with the sheet width BB can be effectively suppressed.

In addition, the reinforcing portion 132 is symmetric relative to a conveyance center line CL of the sheet P. Here, conveyance center line CL refers to a line that constitutes a conveyance reference when various types of sheets P with different sheet widths are conveyed without changing the position of the central portion in the leftward/rightward direction. In other words, the reinforcing portion 132 is symmetric relative to a plane which contains the conveyance center line CL and is perpendicular to the leftward/rightward direction. More specifically, the rigidity distribution of the main part 135 in the leftward/rightward direction is symmetric relative to the conveyance center line CL of the sheet P.

Here, the term "symmetric" refers to a relationship wherein a volume of a region of the reinforcing portion 132 on one side of the conveyance center line CL in the leftward/rightward direction and a volume of a region of the reinforcing portion 132 on the other side are between 80 and 125 percent.

In this way, in comparison to configurations wherein for instance the base portion or reinforcing portion is not symmetric relative to the conveyance center line CL, the main part 135 can be imparted with a arcuate shape that is symmetric relative to the conveyance center line CL, and the sheet P can thereby be conveyed straight along the conveyance center line CL.

Incidentally, the reinforcing portion 132 has a leftward/rightward width BA in the leftward/rightward direction which can be ranging from 20 to 180 mm, 30 to 170 mm, or 40 to 160 mm.

In addition, the rigidity distribution of the main part 135 in the leftward/rightward direction is constant within a minimum sheet width BS. Here, minimum sheet width BS refers to the width of a minimum size sheet PS having the smallest sheet P width which can be specified with the laser printer 1, in other words the minimum sheet width which can be set using a width guide on the sheet supply tray 31. For example, the minimum sheet width BS can be set to the width of postcards (100 mm).

In this way, the minimum size sheet PS can be conveyed on a straight path in the frontward/rearward direction in comparison to configurations wherein the rigidity distribution of the main part of the nip plate is not constant within the minimum sheet width.

In addition to the effects described above, the present embodiment can also accomplish the effects described below. Since the frontward and rearward ends of the second frame 162 are each provided with one of the first frames 161, respective end portions of the first frames 161 in the leftward/rightward direction can be bent away from each other in the frontward/rearward direction, and thus the main part 135 can be effectively deformed.

Moreover, the present invention is not limited to the aforementioned embodiment, and can be utilized in a variety of configurations, as described below. In the descriptions below, members with substantially the same structure as in the aforementioned embodiment are assigned the same symbols, and descriptions thereof are omitted.

Figures 5A, 5B:
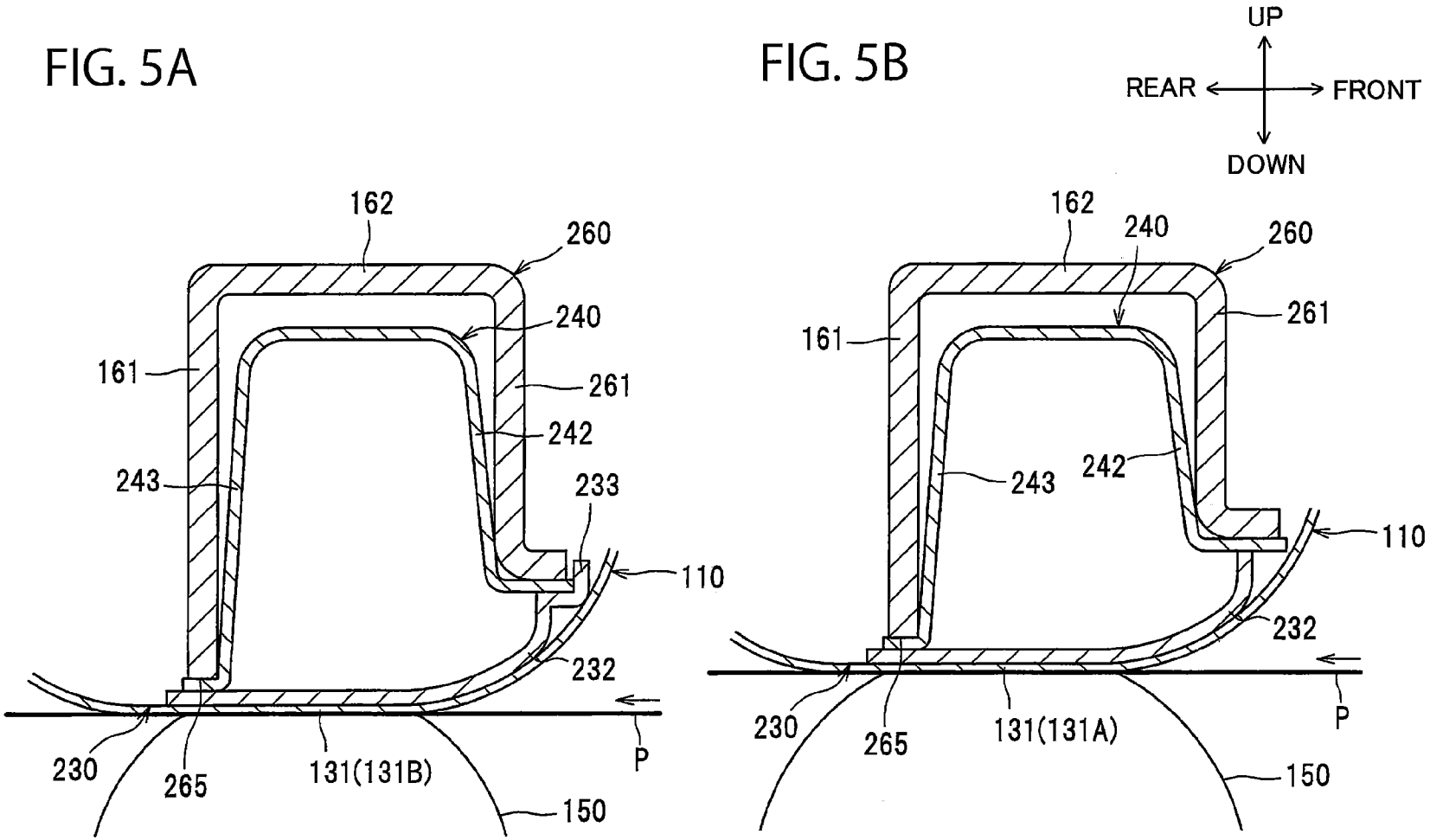
FIGS. 5A and 5B are cross sectional views of the nip plate according to a modification.

With the above-described present embodiment, the nip plate 130 was formed into a substantially planar shape. However, the present invention is not limited to this configuration. As a modification, as shown in FIGS. 5A and 5B, the nip plate 230 can be configured to have a base portion 131, a bending portion 232, and a reinforcing portion 233, wherein the base portion 131 has an elongated shape in the leftward/rightward direction, the bending portion 232 bends upward (toward a stay 260) from a front end portion of the base portion 131, and the reinforcing portion 233 protrudes frontward from an end of the bending portion 232 and then bends upward. Here, FIG. 5A is a cross-sectional view taken along a central portion of the nip plate 230 in the leftward/rightward direction, and FIG. 5B is a cross-sectional view taken along an end portion of the nip plate 230 in the leftward/rightward direction.

The bending portion 232 is formed so as to extend from one end to another end of the base portion 131. The reinforcing portion 233 is formed in a central portion of the bending portion 232 in the leftward/rightward direction. In other words, the reinforcing portion 233 is provided to the base portion 131 through the bending portion 232.

When employing such a nip plate 230, a lower edge face of a first frame 261 at the front side of a stay 260 can be offset farther upward than a lower edge face of the first frame 161 at the rear side of the stay 260, and the lower edge face of a front wall 242 of a reflection plate 240 can be offset farther upward than the lower edge face of a rear wall 243 of the reflection plate 240.

In this modification, the nip plate 230 can be used to increase the rigidity of the central portion of the nip plate 230 in the leftward/rightward direction, and thus the same effect can be achieved as with the aforementioned embodiment. In other words, the nip plate 230 can be imparted with a arcuate shape wherein the central portion central portion 131B (see FIG. 5A) protrudes farther toward the pressure roller 150 than do the end portions (see the first end portion 131A shown as a representative in FIG. 5B).

The aforementioned embodiment was configured such that the supporting faces 165 supports the nip plate 130 indirectly through the reflection plate 140. However, the present invention is not limited to this configuration. The stay can alternatively support the nip plate directly.

With the pressure roller 150 shown as an example of a rotating body in the aforementioned embodiment, the diameter of the end portions 152A and 152C is larger than the diameter of the central portion 152B. However, the present invention is not limited to this configuration. The pressure roller can be configured such that, at least during fixing operation, the diameter of the end portions is larger than the diameter of the central portion.

For example, the pressure roller can be configured to have a shaft, an elastic layer coating the shaft, and a tube coating the elastic layer, and to have wrinkles on the respective end portions of the tube in the axial direction. In this case, when fixing operation is not being performed, the respective end portions and the central portion of the pressure roller have substantially the same diameter. However, when fixing operation is being performed, i.e. when heat is applied to the pressure roller, the pressure roller expands to unwrinkle, and the respective diameters of the end portions of the pressure roller become larger than the diameter of the central portion.

In addition, for example, the pressure roller can be configured to have a shaft and an elastic layer coating the shaft, wherein the diameter of the respective end portions of the shaft is smaller than the diameter of the central portion, and the diameter of the elastic layer is constant. In this case as well, when fixing operation is not being performed, the respective end portions and the central portion of the pressure roller have substantially the same diameter. However, due to the fact that the elastic layer becomes thicker at the respective end portions and thinner at the central portion, when fixing operation is being performed, i.e. when heat is applied to the pressure roller, the end portions of the elastic layer expand more than does the central portion, and the respective diameters of the end portions of the pressure roller become larger than the diameter of the central portion.

In the aforementioned embodiment, sheets P such as normal paper and postcards were given as examples of recording sheets. However, the present invention is not limited to these examples. The sheets can also be, for example, overhead projector sheets.

In the aforementioned embodiment, the present invention was employed in the laser printer 1. However, the present invention is not limited to this configuration. For example, the present invention can also be employed in other image forming devices such as copying machines and multi-function printers.

In the aforementioned embodiment, the pressure roller 150 was shown as an example of a rotating body. However, the present invention is not limited to this configuration. For example, the rotating body can alternatively be a belt-shaped rotating body. Incidentally, in this case, the axial direction of one of multiple rollers supporting the belt will be the axial direction of the rotating body.

In the aforementioned embodiment, the halogen lamp 120 was shown as an example of a heater. However, the present invention is not limited to this configuration. For example, a carbon heater can be used.

What is claimed is:

1. A fixing device comprising:

a metal plate having a main part comprising a first end portion, a second end portion, and a center portion, the center portion being positioned between the first end portion and the second end portion and having a rigidity higher than that of the first end portion and the second end portion;

an endless belt having an outer peripheral surface and an inner peripheral surface configured to be in sliding contact with the metal plate in a sliding direction;

a rotating body that is configured to rotate and defines an axial direction, the metal plate and the rotating body being configured to nip the endless belt therebetween, the endless belt and the rotating body being configured to form a nip region therebetween, the main part being aligned with the rotating body in a direction from the metal plate to the rotating body, and the second end portion being opposite to the first end portion with respect to the center portion in the axial direction; and a stay disposed opposite to the nip region with respect to the metal plate, and configured to receive a load from the rotating body through the metal plate, the stay and the main part of the metal plate being configured to deform such that the main part provides a convex shape protruding toward the rotating body when the stay receives a load from the rotating body through the metal plate.

2. The fixing device according to claim 1, wherein the main part provides a rigidity distribution in the axial direction, the rigidity distribution being symmetrical with respect to a conveyance center line of a recording sheet.

3. The fixing device according to claim 1, wherein the main part extends in the axial direction during a load-free situation.

4. The fixing device according to claim 1, wherein the main part comprises:

a base portion confronting the rotating body and including the first end portion, the second end portion, and the center portion, and a reinforcing portion provided at the center portion.

5. The fixing device according to claim 4, wherein the base portion has an edge in the sliding direction; and wherein the reinforcing portion bendingly extends from the edge toward the stay.

6. The fixing device according to claim 4, wherein the base portion has one end and another end in the axial direction;

wherein the base portion has an edge in the sliding direction; and wherein the main part further comprises a bending portion extending from the one end to the another end of the base portion and protruding from the edge toward the stay, the bending portion having an end in the sliding direction, and the reinforcing portion protruding from the end of the bending portion.

7. The fixing device according to claim 4, wherein the reinforcing portion is symmetrical with respect to a conveyance center line of a recording sheet.

8. The fixing device according to claim 4, wherein the reinforcing portion in its entirety has a width narrower than a width of a recording sheet in the axial direction, and is disposed within the width of the recording sheet.

9. The fixing device according to claim 8, wherein the width of the recording sheet is 176 mm.

10. The fixing device according to claim 8, wherein the width of the recording sheet is 215.9 mm.

11. The fixing device according to claim 8, wherein the width of the recording sheet is 210 mm.

12. The fixing device according to claim 1, wherein the main part has a rigidity distribution in the axial direction, the rigidity distribution being uniform within a minimum width of a recording sheet.

13. The fixing device according to claim 1, wherein the rotating body is a roller having a first end part, an intermediate part, and a second end part opposite to the first end part with respect to the intermediate part in the axial direction, the first end part and the second end part having diameters larger than a diameter of the intermediate part at least during a fixing operation.

14. The fixing device according to claim 1, wherein the rotating body is a roller having a first end part, an intermediate part, and a second end part opposite to the first end part with respect to the intermediate part in the axial direction, the first end part and the second end part having diameters larger than a diameter of the intermediate part when a fixing operation is not being performed.

* * * * *